US010165862B2

(12) United States Patent
Schmitz et al.

(10) Patent No.: US 10,165,862 B2
(45) Date of Patent: Jan. 1, 2019

(54) SUPPORT STRUCTURE FOR SADDLE-FORM SEAT SURFACE

(71) Applicants: Johann Burkhard Schmitz, Berlin (DE); Carola E. M. Zwick, Berlin (DE); Roland R. O. Zwick, Berlin (DE)

(72) Inventors: Johann Burkhard Schmitz, Berlin (DE); Carola E. M. Zwick, Berlin (DE); Roland R. O. Zwick, Berlin (DE)

( * ) Notice: Subject to any disclaimer, the term of this patent is extended or adjusted under 35 U.S.C. 154(b) by 0 days.

(21) Appl. No.: 15/402,067

(22) Filed: Jan. 9, 2017

(65) Prior Publication Data

US 2017/0112287 A1 Apr. 27, 2017

Related U.S. Application Data

(63) Continuation-in-part of application No. PCT/US2016/040126, filed on Jun. 29, 2016, which is a continuation-in-part of application No. 14/355,162, filed as application No. PCT/EP2012/004535 on Oct. 30, 2012, now Pat. No. 9,538,848.

(Continued)

(30) Foreign Application Priority Data

Oct. 31, 2011 (DE) ..... 10 2011 117 285

(51) Int. Cl.

| | |
|---|---|
| ***B60N 2/38*** | (2006.01) |
| ***A47C 7/02*** | (2006.01) |
| ***A47C 9/02*** | (2006.01) |

(52) U.S. Cl.

CPC ..... *A47C 7/029* (2018.08); *A47C 9/02* (2013.01)

(58) Field of Classification Search

CPC .. A47C 7/00; A47C 7/022; A47C 9/02; A47C 9/005; A47C 9/025; A47C 7/004; A47C 7/006; A47C 7/002

(Continued)

(56) References Cited

U.S. PATENT DOCUMENTS

| | | | |
|---|---|---|---|
| 1,111,586 | A | 9/1914 | Hurlbert |
| 1,620,448 | A | 3/1927 | Dourboufis |

(Continued)

FOREIGN PATENT DOCUMENTS

| | | |
|---|---|---|
| CN | 2137900 | 7/1993 |
| CN | 2206579 | 9/1995 |

(Continued)

OTHER PUBLICATIONS

Office Action from the Intellectual Property Office of the People's Republic of China for Application No. 20128005355.2 dated Nov. 25, 2015 (9 pages).

(Continued)

*Primary Examiner* — Chi Q Nguyen

(74) *Attorney, Agent, or Firm* — Michael Best & Friedrich LLP

(57) ABSTRACT

A seating structure includes a frame, a carrier, and a suspension material. The frame includes front, rear, and side portions that define a continuous outer periphery of the frame. The frame further includes a cross portion extending between the side portions. The frame also includes openings in the front and rear portions, with the cross portion between the openings. The cross portion includes stiffening ribs. The carrier includes a suspension material connected to the outer periphery of the frame. The frame and carrier have respective first and second attachment features that engage to lock the carrier onto the frame.

20 Claims, 3 Drawing Sheets

Related U.S. Application Data

(60) Provisional application No. 62/185,932, filed on Jun. 29, 2015, provisional application No. 62/266,200, filed on Dec. 11, 2015.

(58) Field of Classification Search
USPC ..... 297/195.11, 202, 195.1, 4, 452.65, 204, 297/452.55, 461
See application file for complete search history.

(56) References Cited

U.S. PATENT DOCUMENTS

| | | | | | |
|---|---|---|---|---|---|
| 2,871,014 | A | | 1/1959 | Haskell | |
| 3,541,313 | A | | 11/1970 | Buzzi | |
| 4,366,981 | A | | 1/1983 | Ziegler et al. | |
| 4,469,372 | A | | 9/1984 | Long | |
| 5,076,642 | A | * | 12/1991 | Beylet | B62J 1/00 297/214 |
| 5,362,126 | A | * | 11/1994 | Bontrager | B62J 1/00 297/195.1 |
| 5,558,396 | A | * | 9/1996 | Yu | B62J 1/02 297/195.1 |
| 7,219,956 | B2 | * | 5/2007 | Zhang | A47B 91/00 297/195.11 |
| 7,401,850 | B2 | | 7/2008 | Micheel | |
| 8,317,267 | B2 | * | 11/2012 | Wallace | A47C 7/022 297/195.11 |
| 8,973,986 | B1 | * | 3/2015 | Marceleno | B62J 1/007 297/199 |
| 9,538,848 | B2 | | 1/2017 | Plikat et al. | |
| 2002/0167206 | A1 | * | 11/2002 | Jalkanen | A47C 7/022 297/202 |
| 2003/0001424 | A1 | | 1/2003 | Mundell et al. | |
| 2003/0218370 | A1 | * | 11/2003 | Langham | A47C 3/18 297/344.22 |
| 2004/0124689 | A1 | | 7/2004 | Numa et al. | |
| 2005/0046247 | A1 | * | 3/2005 | Saccucci | B62J 1/08 297/215.15 |
| 2005/0088029 | A1 | | 4/2005 | Stokes | |
| 2006/0102816 | A1 | * | 5/2006 | Zhang | A47B 91/00 248/188.2 |
| 2010/0013278 | A1 | * | 1/2010 | Segato | B62J 1/00 297/215.16 |
| 2011/0316319 | A1 | * | 12/2011 | Lukic | A47C 16/025 297/423.44 |
| 2014/0110980 | A1 | * | 4/2014 | Attey | B62J 1/02 297/215.16 |

FOREIGN PATENT DOCUMENTS

| | | |
|---|---|---|
| CN | 1278419 | 1/2001 |
| CN | 101305869 | 11/2008 |
| EP | 2172135 | 4/2010 |
| FR | 2868923 | 10/2005 |
| WO | 0078595 | 12/2000 |

OTHER PUBLICATIONS

International Preliminary Report on Patentability issued in corresponding PCT Patent Application No. PCT/EP2012/004535 dated May 15, 2014 (9 pages).

* cited by examiner

SUPPORT STRUCTURE FOR SADDLE-FORM SEAT SURFACE

CROSS REFERENCE TO RELATED APPLICATIONS

This application is a continuation-in-part of International application Ser. No. PCT/US2016/040126 filed Jun. 29, 2016, which claims priority to U.S. Provisional Patent Application No. 62/185,932, filed Jun. 29, 2015, and to U.S. Provisional Patent Application No. 62/266,200, filed Dec. 11, 2015. This application is also a continuation-in-part of U.S. patent application Ser. No. 14/355,162 filed Apr. 29, 2014 which is a national phase application from International application Ser. No. PCT/EP2012/004535 filed Oct. 30, 2012, which claims priority to German Patent Application No. 10 2011 117 285.1 filed Oct. 31, 2011. The entire contents of all foregoing applications to which this application claims priority are incorporated by reference herein.

BACKGROUND

The present invention relates to a support structure for a saddle-form seat surface utilizing a suspension material.

SUMMARY

In one embodiment, the invention provides a piece of seating furniture comprising: a frame in the shape of a saddle and including a front portion, a first side portion, a second side portion, a rear portion, and a cross portion interconnecting the first and second side portions; a suspension material interconnected to the front portion, first side portion, second side portion, and rear portion of the frame; wherein the front portion, first side portion, second side portion, and rear portion together define a continuous outer periphery of the frame; and wherein at least a portion of the suspension material is spaced from a support surface of the cross portion of the frame.

In some embodiments, the front portion is arched higher than the rear portion. In some embodiments, the front portion and rear portion each define an opening. In some embodiments, the rear portion includes an opening over which the suspension material supports an occupant. In some embodiments, the first side portion and second side portion are tapered between the front and rear portions.

In some embodiments, the cross portion includes stiffening ribs between the front portion, first side portion, second side portion, and rear portion. In some embodiments, the seating furniture further comprises a base and a support column connected to the base; wherein the cross portion includes a central hole for receiving an end of the support column to connect the frame to the base; and wherein the stiffening ribs define an X centered on the central hole. In some embodiments, the stiffening ribs are arcuate and tangent to the central hole.

In some embodiments, at least one of the front and rear portion of the frame is secured to the suspension material via horizontally-extending teeth received in horizontally-opening apertures.

In some embodiments, the seating furniture further comprises a carrier to which the suspension material is connected, the carrier fitting around the entire outer periphery of the frame. In some embodiments, the carrier holds the suspension material in a state of radially-directed tension. In some embodiments, the outer periphery of the frame includes a plurality of first attachment features and the carrier includes a plurality of second attachment features engaging the first attachment features. In some embodiments, the first attachment features and second attachment features include teeth and apertures. In some embodiments, the outer periphery of the frame includes horizontally-extending teeth in the front portion and rear portion and vertically-extending teeth in the first and second side portions; and the carrier includes horizontally-opening apertures receiving the horizontally-extending teeth and vertically-opening apertures receiving the vertically-opening teeth. In some embodiments, wherein the carrier forms a closed loop. In some embodiments, the carrier is continuously connected around the entire periphery of the frame.

In some embodiments, the suspension material is spaced above the cross portion of frame.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
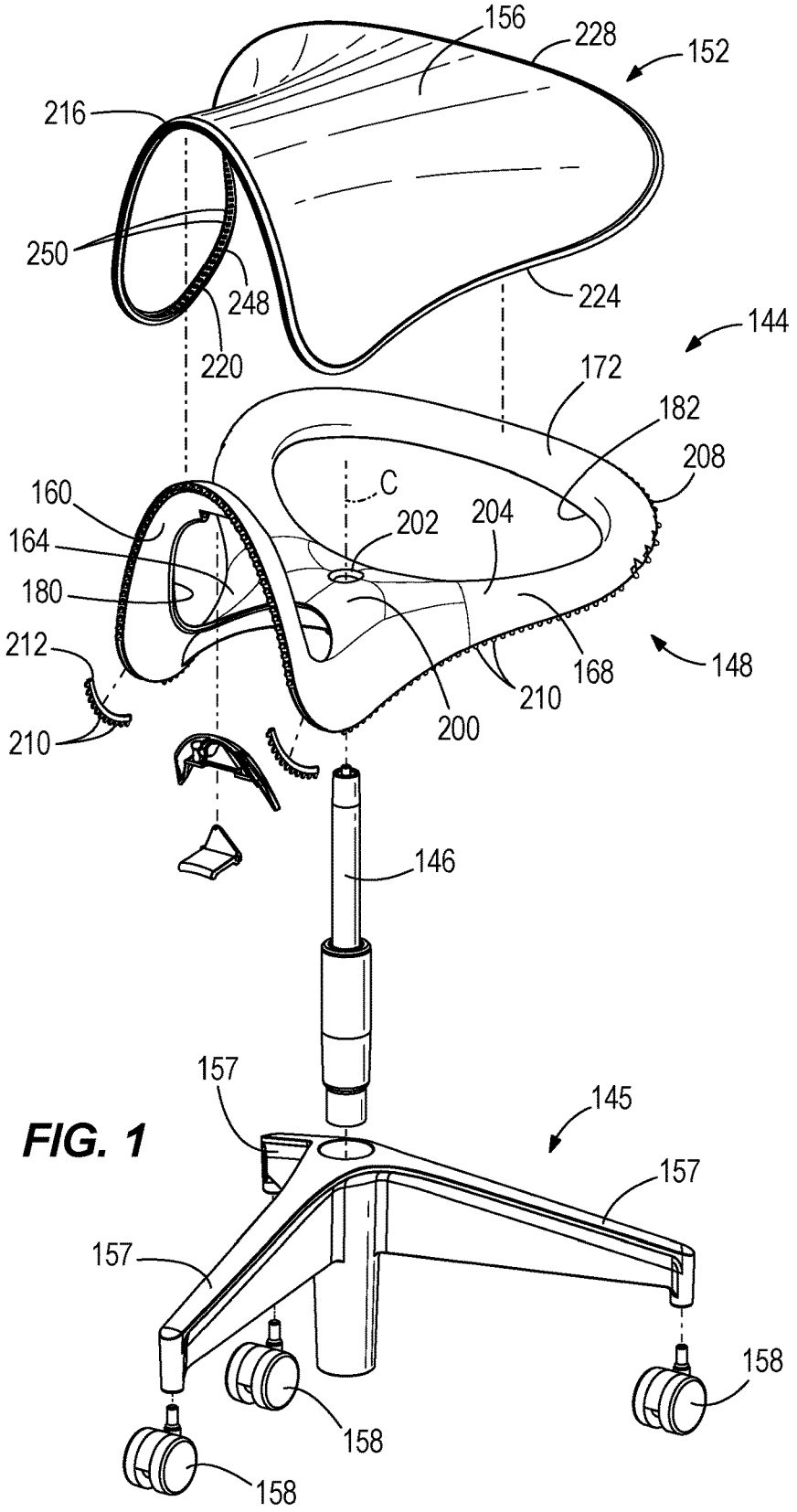
FIG. 1 is an exploded view of a stool according to some embodiments of the present invention.

FIG. 1 illustrates a seating structure 144 embodying the present invention. The illustrated seating structure 144 is a saddle-shaped stool and may also be called a scooter. The stool includes a base 145, a support column 146, a frame 148, a carrier 152, and a suspension material 156. With additional reference to FIG. 2, the frame 148, the carrier 152, and the suspension material 156 of the seating structure 144 are configured to form a stool with a relatively high, narrow front and a relatively short, wide back.

With reference to FIG. 1, the support column 146 defines a vertical column axis C. The illustrated support column 146 includes telescoping pneumatic tubes that allow a height of the seating structure 144 to be vertically adjusted. For example, in some embodiments, the support column 146 may include a gas pressure spring. The support column 146 is rotationally fixed to the base 145. With additional reference to FIGS. 2-4, the base 145 includes three legs 157. Each leg 157 includes a caster 158. The forward-extending leg 157 extends along a base axis B (FIG. 3) that is perpendicular to and intersects the column axis C. When seated on the seating structure 144, an occupant's feet 159 straddle the base axis B and effectively become fourth and fifth legs of the seating structure 144. Because the occupant's feet 159 are actively involved in the seating structure 144 architecture, the occupant is able to easily and intuitively move the seating structure 144 like a scooter on the casters 158 to desired positions. Additionally, the active involvement of the occupant in the seating structure 144 architecture keeps the occupant engaged in the act of sitting and balancing. The frame 148 is carried by the support column 146. The support column 146 connects the frame 148 to the base 145 in a rotationally fixed manner to ensure constant proper alignment of the three legs 157 with a user sitting on the seating structure 144.

With reference to FIGS. 1-3 and 5, the frame 148 includes a front portion 160, a first side portion 164, a second side portion 168, and a rear portion 172. The curvature (when viewed horizontally from the front) of the front portion 160 describes a relatively high arch with a relatively narrow base compared to the curvature (when viewed horizontally from the rear) of the rear portion 172, which describes a relatively low arch having a relatively wide base. The first and second side portions 164, 168 extend between the front and rear portions 160, 172. The front portion 160 rises higher (in a vertical direction with respect to the floor supporting the seating structure 144) than the first and second side portions 164, 168. In the illustrated embodiment, the front portion 160 also rises higher than the rear portion 172. The front portion 160 includes a front opening 180 and the rear portion 172 includes a rear opening 182.

Figure 3:
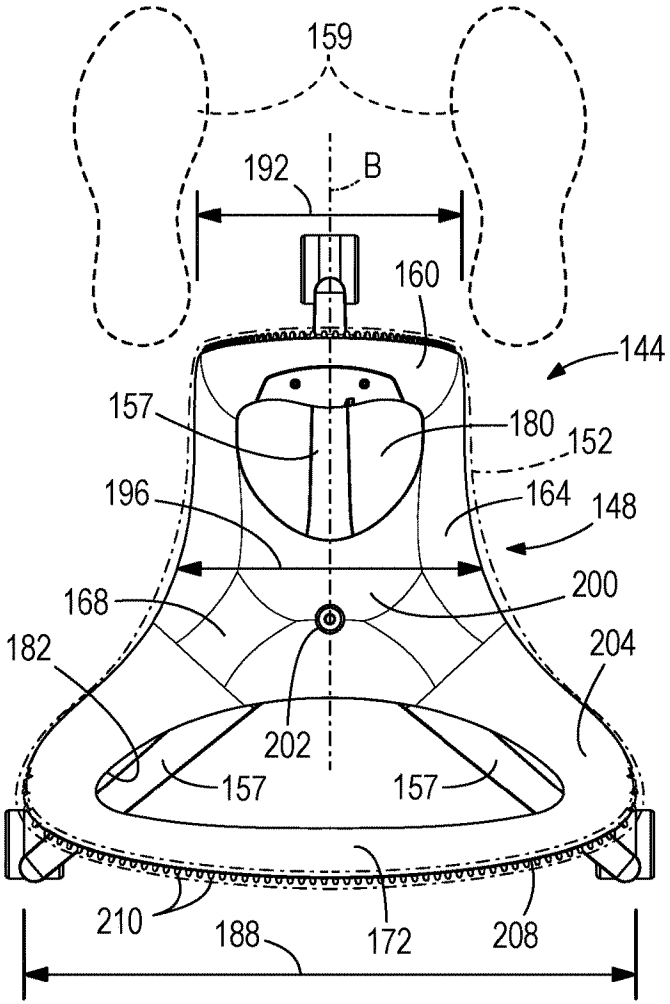
FIG. 3 is a top view of the stool of FIG. 1.
Figure 4:
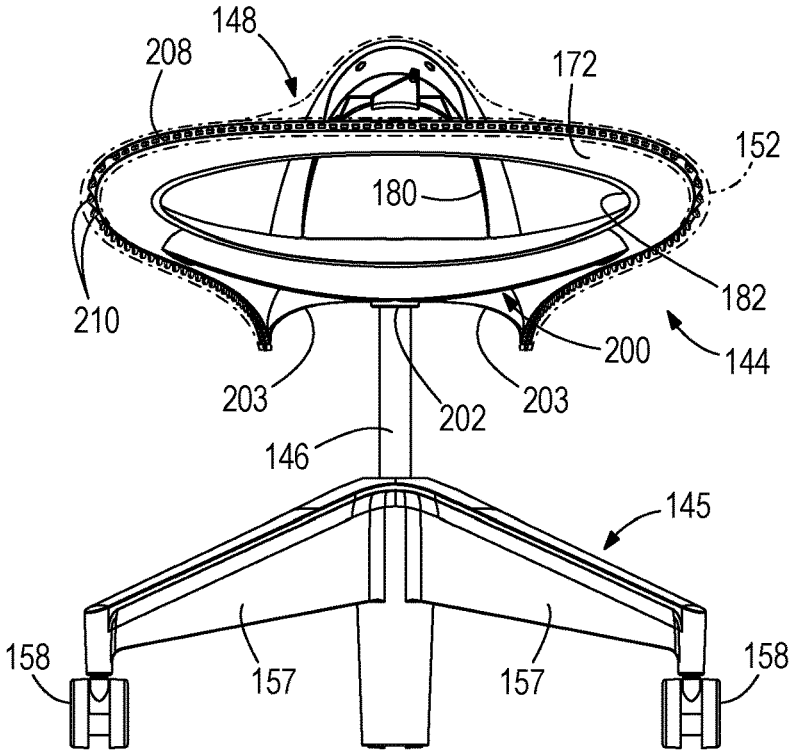
FIG. 4 is a rear view of the stool of FIG. 1.
Figure 5:
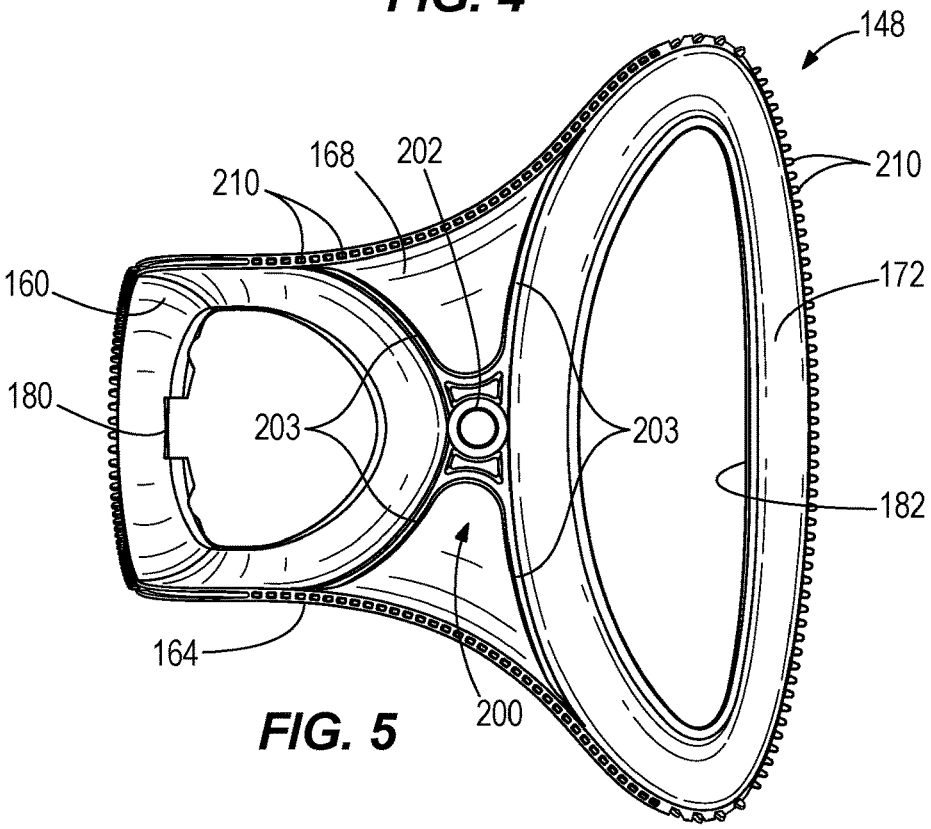
FIG. 5 is a bottom view of the seat frame of the stool of FIG. 1.

Referring now particularly to FIGS. 3-5, a cross portion 200 is between the front and rear openings 180, 182 and between the first and second side portions 164, 168. The cross portion includes a central hole 202 and ribs 203 forming an "X" shape centered on or symmetrical about the central hole 202. The ribs 203 may also be described as two arcuate ribs, each tangent to the central hole 202. The central hole 202 receives the support column 146 to connect the seat frame 148 with the base 145. In the illustrated embodiment, the seat frame 148 is rotationally fixed to the support column 146. In some embodiments, the seat frame 148 is rotatably coupled to the support column 146 for rotation about the column axis C.

With reference to FIG. 3, the frame 148, when viewed from above, has a shape similar to a figure "8" with the front and rear portions 160, 172 forming continuous, unbroken, closed loops or rings around the respective front and rear openings 180, 182 and the cross portion 200 separating the openings 180, 182. The rear opening 182 is wider than the front opening 180 when viewed from above (FIG. 3) or below (FIG. 5). The rear portion 172 has a maximum width 188 that is wider than a maximum width 192 of the front portion 160, and the rear portion 172 can therefore be termed "wider" than the front portion 160. The first side portion 164 and the second side portion 168 are curved or tapered such that a width 196 of the frame 148 (as viewed from above) decreases slightly from the front portion 160 to cross portion 200 and then increases from the cross portion 200 to the rear portion 172.

With continued reference to FIGS. 1 and 3, the frame 148 includes a support surface 204 (i.e., the surfaces of the various portions 160, 164, 168, 172, 200) and an outer periphery 208. The outer periphery 208 forms a continuous, unbroken, closed loop or ring around the entire frame 148 (i.e., around the portions 160, 164, 168, 172). The outer periphery 208 includes a plurality of outwardly extending first attachment features 210. Because the outer periphery 208 at the front and rear portions 160, 172 extends generally horizontally, the first attachment features 210 also extend horizontally at the front and rear portions 160, 172. The outer periphery 208 in the first and second side portions 164, 168 extends generally vertically and as a result the first attachment features 210 extend vertically in the first and second side portions 164, 168. The outer periphery 208 and the first attachment features 210 therefore form a track that transitions from horizontally-extending (in the front and rear portions 160, 172) to vertically-extending (in the first and second side portions 164, 168) around the frame 148.

In the illustrated embodiment, the first attachment features 210 are teeth. In the illustrated embodiment, some of the first attachment features 210 are integrally formed with the frame 148. In the embodiment illustrated in FIG. 1, the frame 148 also includes insert members or attachable strips 212 that include first attachment features 210. The first attachment features 210 are integrally formed with the attachable strips 212. The attachable strips 212 can be attached to the frame 148 outer periphery 208 to continue the line of first attachment features 210. The illustrated attachable strips 212 are separate pieces from the frame 148, but may alternatively be integrally formed with the frame 148.

As shown in FIG. 1, the carrier 152 defines a continuous or unbroken or closed loop or ring comprising a front portion 216, a first side portion 220, a second side portion 224, and a rear portion 228. The loop or ring of the carrier 152 includes a plurality of second attachment features 250 on an inner periphery 248 of the loop or ring. The second attachment features 250 extend or face inwardly from the inner periphery 248. The second attachment features 250 are designed to mate with or receive the first attachment features 210 and are consequently horizontally-facing in the front and rear portions 216, 228 and vertically-facing in the first and second side portions 220, 224. The inner periphery 248 of the carrier 152 and the second attachment features 250 therefore form a track that transitions from horizontally-facing (in the front and rear portions 216, 228) to vertically-facing (in the first and second side portions 220, 224) around the frame carrier 152.

In the illustrated embodiment, the second attachment features 250 are apertures that receive the teeth of the first attachment features 210 to connect the carrier 152 to the frame 148. In other embodiments, the first and second attachment features 210, 250 may be switched such that the carrier 152 includes the teeth and the frame 148 includes the apertures. In other embodiments combinations of teeth and apertures can be provided on both the carrier 152 and frame 148 such that all the teeth on one component mate with an aperture on the other. In other embodiments, mating parts other than teeth and apertures may be used as the first and second attachment features.

The suspension material 156 is coupled to the carrier 152. In the illustrated embodiment, the outer edge or periphery of the suspension material 156 is molded into the carrier 152. In alternative embodiments, the suspension material 156 may be coupled to the carrier 152 using other suitable coupling means. The suspension material 156 may be made of a woven or knit material, such as elastomeric materials, fabrics, or molded polymeric materials. The suspension material 156 is within the continuous loop or ring of the carrier 152 and is held in a state of radially-directed tension by the carrier 156.

When the carrier 152 is connected to the frame 148, the suspension material 156 is stretched over the openings 180, 182 of the frame 148. The suspension material 156 is only connected to the frame 148 by way of the carrier 152. Because the carrier 152 is in contact with the entire periphery of the frame 148, the suspension material 156 is also interconnected with the entire periphery of the frame 148.

Figure 2:
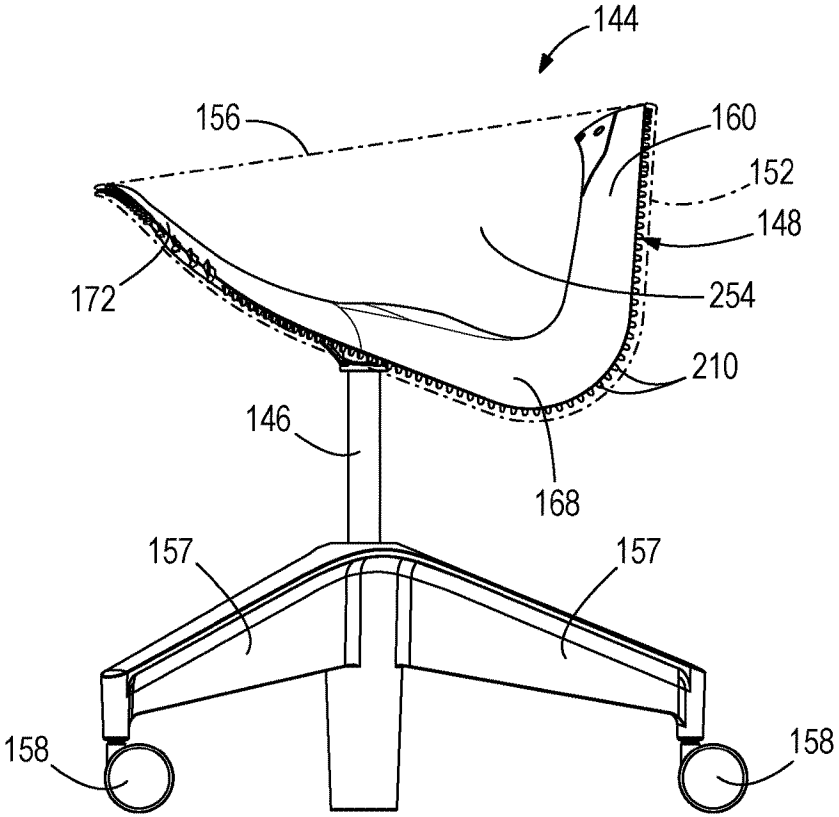
FIG. 2 is a side view of the stool of FIG. 1.

As shown in FIG. 2, the suspension material 156 stretches between the front portion 160 and rear portion 172, leaving a space 254 above the frame 148. The suspension material 156 deflects under the weight of an occupant down toward the frame 148. The seating structure 144 is designed so that at least a portion of the suspension material 156 is out of contact with the frame 148 when an occupant sits on the seating structure 144. Under the weight of most occupants, the central area of the suspension material 156 is spaced apart from and does not contact the frame 148. Even if the weight of the occupant pushes the suspension material 156 down against most of the frame 148, the portion of the suspension material 156 over the first and second openings 180, 182 creates a pliable or flexible support for the occupant.

The front portion 160 of the frame 148 defines a "horn" portion of the saddle, the rear portion 172 of the frame 148 forms a raised rear support portion, and the two curved side portions 164, 168 are configured to engage the user's thighs. In some embodiments, the carrier 152 may include a plurality of ribs positioned along portions of the carrier 152 that may experience point loading, such as along the first and second side portions 164, 168.

Various features and advantages of the invention are set forth in the following claims.

What is claimed is:

1. A piece of seating furniture comprising:

a frame in a shape of a saddle and including a front portion, a first side portion, a second side portion, a rear portion, and a cross portion interconnecting the first and second side portions;

a suspension material interconnected to the front portion, first side portion, second side portion, and rear portion of the frame;

wherein the front portion, first side portion, second side portion, and rear portion together define a continuous outer periphery of the frame;

wherein at least a portion of the suspension material is spaced from a support surface of the cross portion of the frame; and a carrier to which the suspension material is connected, the carrier fitting around an entire outer periphery of the frame.

2. The piece of seating furniture of claim 1, wherein the front portion is arched higher than the rear portion.

3. The piece of seating furniture of claim 1, wherein the front portion and rear portion each defines an opening.

4. The piece of seating furniture of claim 3, further comprising a base and a support column connected to the base; wherein the cross portion includes a central hole for receiving an end of the support column to connect the frame to the base; and wherein the stiffening ribs are arcuate and tangent to the central hole.

5. The piece of seating furniture of claim 1, wherein the rear portion includes an opening over which the suspension material supports an occupant.

6. The piece of seating furniture of claim 5, further comprising a base and a support column connected to the base; wherein the cross portion includes a central hole for receiving an end of the support column to connect the frame to the base; and wherein the stiffening ribs define an X centered on the central hole.

7. The piece of seating furniture of claim 1, wherein the first side portion and second side portion are tapered between the front and rear portions.

8. The piece of seating furniture of claim 1, wherein the cross portion includes stiffening ribs between the front portion, first side portion, second side portion, and rear portion.

9. The piece of seating furniture of claim 1, wherein at least one of the front and rear portion of the frame is secured to the suspension material via horizontally-extending teeth received in horizontally-opening apertures.

10. The piece of seating furniture of claim 1, wherein the carrier holds the suspension material in a state of radially-directed tension.

11. The piece of seating furniture of claim 1, wherein the outer periphery of the frame includes a plurality of first attachment features and the carrier includes a plurality of second attachment features engaging the first attachment features.

12. The piece of seating furniture of claim 11, wherein the first attachment features and second attachment features include teeth and apertures.

13. The piece of seating furniture of claim 1, wherein:

the outer periphery of the frame includes horizontally-extending teeth in the front portion and rear portion and vertically-extending teeth in the first and second side portions; and the carrier includes horizontally-opening apertures receiving the horizontally-extending teeth and vertically-opening apertures receiving the vertically-opening teeth.

14. The piece of seating furniture of claim 1, wherein the carrier forms a closed loop.

15. The piece of seating furniture of claim 1, wherein the carrier is continuously connected around the entire periphery of the frame.

16. The piece of seating furniture of claim 1, wherein the suspension material is spaced above the cross portion of frame.

17. The piece of seating furniture of claim 1, further comprising a base and a support column connected to the base, wherein the frame is carried by the support column, and wherein the support column connects the frame to the base in a rotationally fixed manner.

18. The piece of seating furniture of claim 17, wherein a height of the support column is vertically adjustable.

19. A piece of seating furniture comprising:

a frame in the shape of a saddle and including a front portion, a first side portion, a second side portion, a rear portion, and a cross portion interconnecting the first and second side portions;

a suspension material interconnected to the front portion, first side portion, second side portion, and rear portion of the frame;

wherein the front portion, first side portion, second side portion, and rear portion together define a continuous outer periphery of the frame;

wherein at least a portion of the suspension material is spaced from a support surface of the cross portion of the frame; and wherein the front portion and rear portion each defines an opening.

20. A piece of seating furniture comprising:

a frame in the shape of a saddle and including a front portion, a first side portion, a second side portion, a rear portion, and a cross portion interconnecting the first and second side portions;

a suspension material interconnected to the front portion, first side portion, second side portion, and rear portion of the frame;

wherein the front portion, first side portion, second side portion, and rear portion together define a continuous outer periphery of the frame;

wherein at least a portion of the suspension material is spaced from a support surface of the cross portion of the frame; and wherein the rear portion includes an opening over which the suspension material supports an occupant.

* * * * *